US006661428B1

(12) United States Patent
Kim

(10) Patent No.: US 6,661,428 B1
(45) Date of Patent: Dec. 9, 2003

(54) DEVICE AND METHOD FOR CONTROLLING LUMINANCE OF FLAT DISPLAY

(75) Inventor: Hak Su Kim, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/550,071

(22) Filed: Apr. 14, 2000

(30) Foreign Application Priority Data

Apr. 15, 1999 (KR) ..... 1999-13375
Apr. 16, 1999 (KR) ..... 1999-13565

(51) Int. Cl.[7] ..... G09G 5/10
(52) U.S. Cl. ..... 345/690; 345/204
(58) Field of Search ..... 345/55, 59, 77, 345/89, 99, 204, 211, 213, 690–693; 315/169.1–169.4

(56) References Cited

U.S. PATENT DOCUMENTS 4,707,638 A * 11/1987 Hara et al. ..... 313/422
4,845,473 A * 7/1989 Matsuhashi et al. ..... 345/103
5,625,376 A * 4/1997 Maekawa ..... 345/55
6,008,789 A * 12/1999 Anai et al. ..... 345/212
6,362,835 B1 * 3/2002 Urbanus et al. ..... 345/589

FOREIGN PATENT DOCUMENTS

JP 02-051192 * 2/1990 ..... G09G/3/12
JP 05-265398 * 10/1993 ..... G09G/3/32

* cited by examiner

*Primary Examiner*—Richard Hjerpe
*Assistant Examiner*—Alexander Eisen
(74) *Attorney, Agent, or Firm*—Fleshner & Kim, LLP

(57) ABSTRACT

Device and method for controlling a luminance of a flat display minimizes a chip area, and controls a luminance of a desired portion of a display efficiently without an additional power consumption. The device includes a reference signal part for receiving an external video signal and provides a duty ratio of a scan signal and a video data desired to display. A controller converts the duty ratio from the reference signal part and generates a remaining scan time period. A display part receives and displays an image data (video data) with the application of scanning pulses having a duty ratio processed by the controller.

33 Claims, 12 Drawing Sheets

$I_H$: high current
$I_L$: low current $V_H$ : high voltage
$V_L$ : low voltage $T_R$ : remained(surplus)time period
$T_F$ : 1frame time period $T_M$ : masking time period

DEVICE AND METHOD FOR CONTROLLING LUMINANCE OF FLAT DISPLAY

BACKGROUND OF THE INVENTION

1. Field of the Invention

The present invention relates to a display, and more particularly, a flat display.

2. Background of the Related Art

Keeping pace with current development of electronic technologies, new flat displays have been developed, which are thinner and lighter, and have a low power consumption according to recent trend of fabricating smaller sized, light weight, and low voltage products, such as a voltage driving type including LCD (Liquid Crystal Display), PDP (Plasma Display Panel), and VFD (Visual Fluorescent Display), and a current driving type including FED (Field Emission Display) and LED (Light Emitting Diode), and EL (Electroluminescence).

FIG. 1 illustrates a related art display device and the flat display driving circuit. A system interface 1 converts an external control signal or data into a control signal required for display device, and a memory 3 stores data of the control signal converted at the system interface 1. A data drive circuit 4 provides the data from the memory 3 to a plurality of data lines, and a control circuit 2 fixes identical duty ratios according to the control signal converted at the system interface 1. A scan drive circuit 5 provides a signal for the fixed duty ratio from the control circuit 2 to a plurality of scan lines. The plurality of scan lines and the plurality of data lines are formed to cross each other, and pixels at the cross points of the scan and data lines are made to selectively emit lights for displaying an image or character desired on display device.

FIG. 2 illustrates a drive timing diagram of a related art flat display and a displayed image according to the drive timing diagram. By selectively driving the scan lines and the data lines, resulting in turning on/off the dots/pixels at the cross points of the scan lines and the data lines, the image/text "LG" is displayed. During a first scan line is 'on', desired data lines are turned on for displaying a data at a desired position. In this type of display, a luminance of a displayed pixel is proportional to turn-on time periods of the scan line and the data line, and the turn-on time period of the scan line is varied with a size of duty ratio and one frame time period.

As shown in FIG. 3, if the duty ratio is set to be 1/40 and one frame time period is $T_F$, each scan line turn-on time period is $T_F$/ 40. When the flat display is driven such that all the turn-on time periods of the data lines are identical, all the pixels in a panel will exhibit the same luminance. When it is intended to display a line or a particular portion in the panel brighter than other portions, a high voltage or a high current is provided to a required data line. Alternatively, the turn-on time of the data line can be adjusted.

FIGS. 4A and 4B illustrate data driving circuits for a related art flat display wherein FIG. 4A illustrates a current driving type circuit and FIG. 4B illustrates a voltage driving type circuit. As shown therein, a data line in a display panel 7 desired to display brighter than other data lines are switched to a higher voltage or a higher current, for supplying the higher voltage or current thereto through a data driver 6.

The related art device and method for controlling a luminance of a flat display has various disadvantages. For example, a larger chip area is required for an additional circuit to provide the higher voltage or current to the data line. There is also some difficulty in always maintaining a stable voltage when the data driving circuit is the voltage driving type, or matching of respective current sources when the data driving circuit is the current driving type. Further, since the data line turn-on time control method requires a PWM (Pulse Width Modulation) circuit to all the data lines, a large chip area is required.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

An object of the present invention is to control a luminance of display device.

Another object of the present invention is to minimize a chip area.

A further object of the present invention is to reduce power consumption.

Still another object of the present invention is to change a duty ratio for adjusting a display time period of lines to control a luminance of a display device without additional power consumption.

To achieve these and other advantages and in accordance with the purpose of the present invention, as embodied and broadly described, the device for controlling a luminance of a flat display includes a reference signal part for receiving an external video signal and providing a duty ratio of a scan signal and a video data desired to display, a controller for converting the duty ratio from the reference signal part and generating a remained scan time period, and a display part for receiving, and displaying the duty ratio converted at the controller and the video data.

The controller includes a frequency convertor for generating a plurality of clocks required for conversion of the duty ratio, a frequency selector for selecting one from the plurality of clocks as a reference clock, a duty ratio controller for setting up the selected reference clock as the duty ratio, a scan signal controller for generating a signal for driving the scan line in the set up duty ratio, and a display controller for synchronizing the duty ratio controller, and the scan signal controller.

The controller includes a scan controller for converting the duty ratio, to change a scan time period within which a scan can be driven for one frame period, and applying a remained scan time period to the scan line desired to display brighter than other scan lines additionally, and a data controller for driving a portion or entire data corresponding to the scan lines applied additionally, and masking the rest of the data.

In another aspect of the present invention, there is provided a method for controlling a luminance of a flat display, including the steps of (1) while frame frequencies are maintained the same, adjusting a duty ratio of a scan time period for generating a remained driving time period, (2) adding the generated remained driving time period to all scan lines desired to display brighter than other scan lines and driving the added scan lines, and (3) displaying only driving data on a plurality of data lines desired to display brighter while the driving data on rest of the data line are masked, for driving the data lines, selectively.

The present invention can be achieved in a whole or in parts by providing a driving circuit for a display device that includes a reference signal generator that receives video signal, the reference signal generator generating a first duty ratio and a video data, a controller receiving the first duty ratio and video data, the controller converting the first duty ratio to a second duty ratio when a luminance of a pixel of the display device is to be changed, the second duty ratio being less than the first duty ratio, a driver circuit that uses the second duty ratio and video data for displaying at least one of image and text.

The present invention can further be achieved in a whole or in parts by providing a controller for a display device that includes a scan controller circuit for converting a first duty ratio based on a first scan time period for each of a plurality of scan lines to a second duty ratio based on a second scan time period within which each scan line is driven for one frame period, and a data controller circuit for driving a portion or entire data corresponding to the scan lines.

The present invention can further be achieved in a whole or in parts by providing a display device that includes a input device receiving a video signal and generating a first duty ratio and video data, a controller that changes the first duty ratio to a second duty ratio, and a display panel having a plurality of scan lines and a plurality of data lines intersecting at a plurality of pixels, said plurality of scan lines being driven based on the second duty ratio and video data being provided to the plurality of data lines to display at least one of an image and text, wherein the second duty ratio is less than the first duty ratio when a brighter luminance is desired for a prescribed number of pixels.

The present invention can further be achieved in a whole or in parts by providing a method for controlling a luminance of a flat display, including the steps of (1) while a frame frequency is maintained, adjusting a duty ratio of a scan time period for generating additional scan time period, and (2) adding the additional scan time period to all scan lines desired to be displayed brighter than other scan lines.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
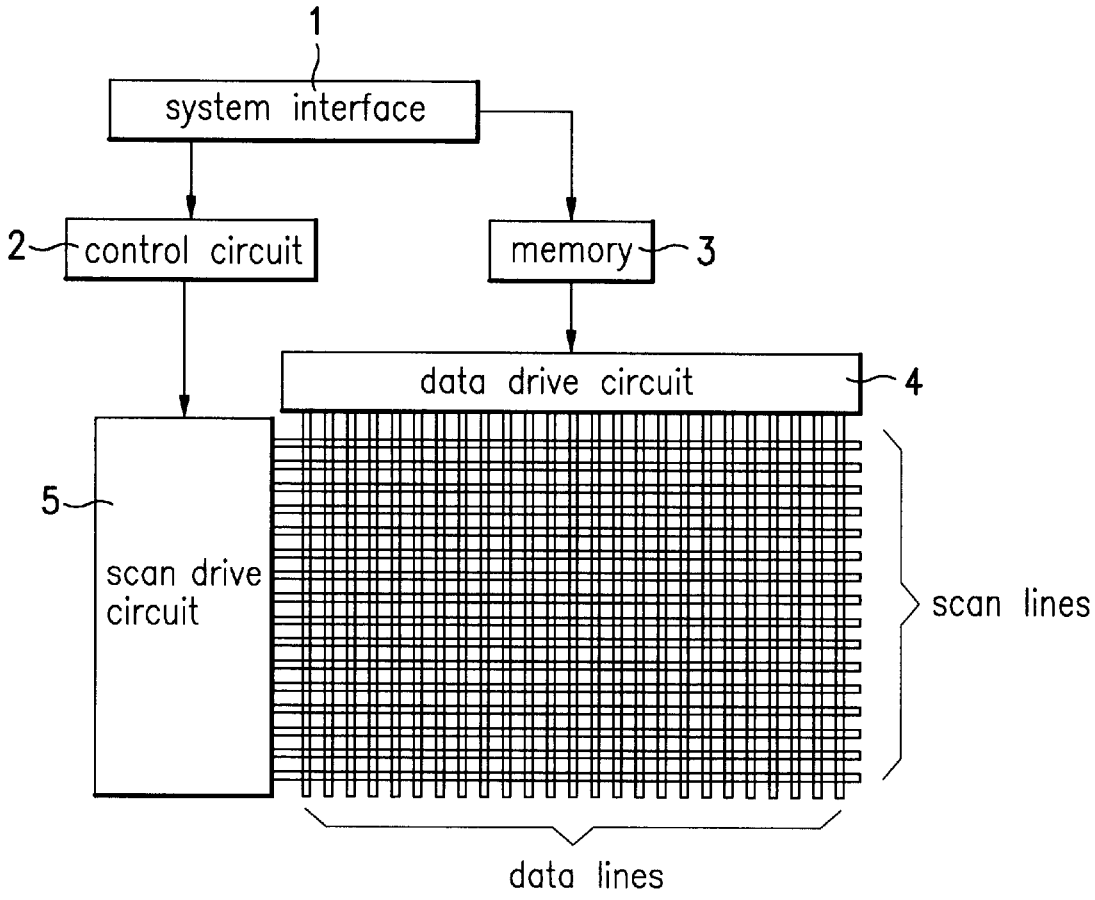
FIG. 1 Related Art
FIG. 1 illustrates a related art flat panel display device.
Figure 2:
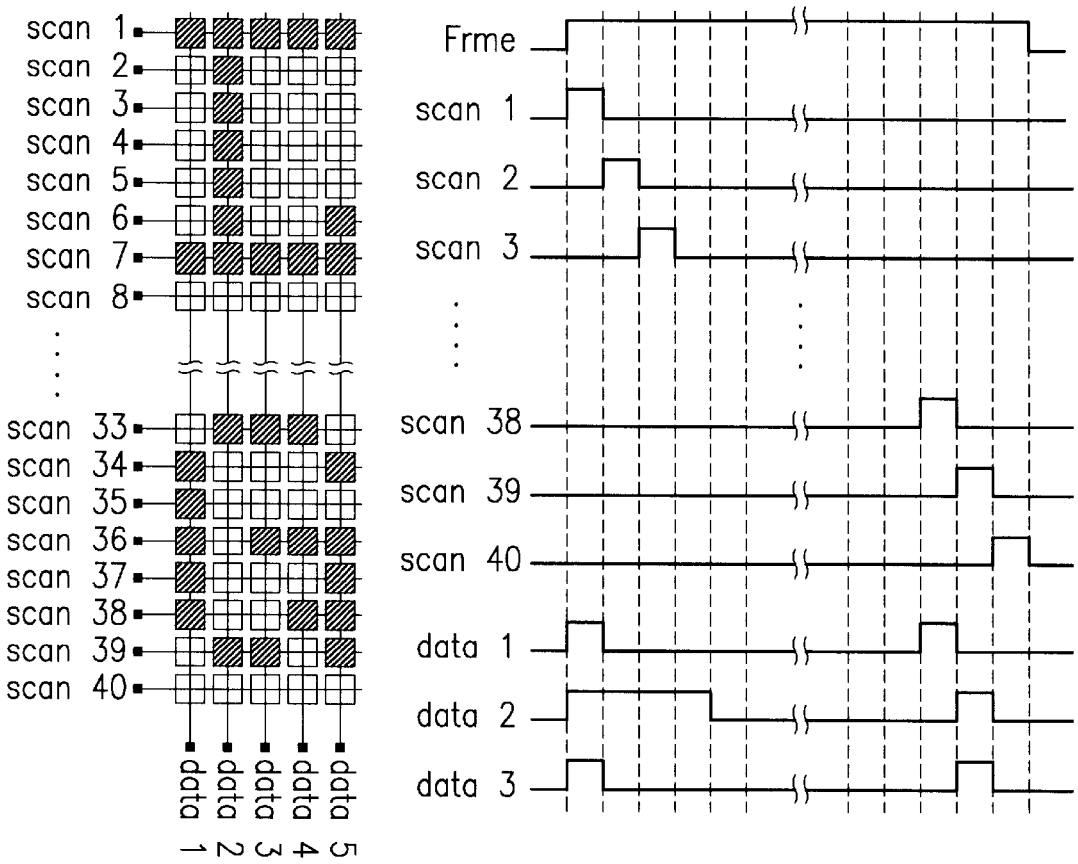
FIG. 2 Related Art
FIG. 2 illustrates a drive timing diagram of a related art display device and the image/text displayed according to the drive timing diagram.
Figure 3:
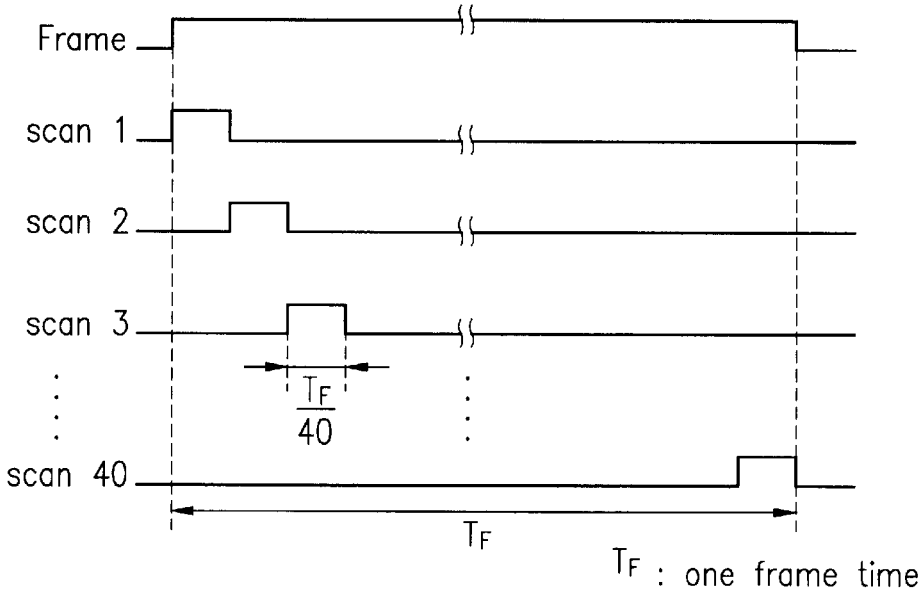
FIG. 3 Related Art
FIG. 3 illustrates a drive timing diagram of related art scan lines each having a duty ratio set to 1/40.
Figure 4A:
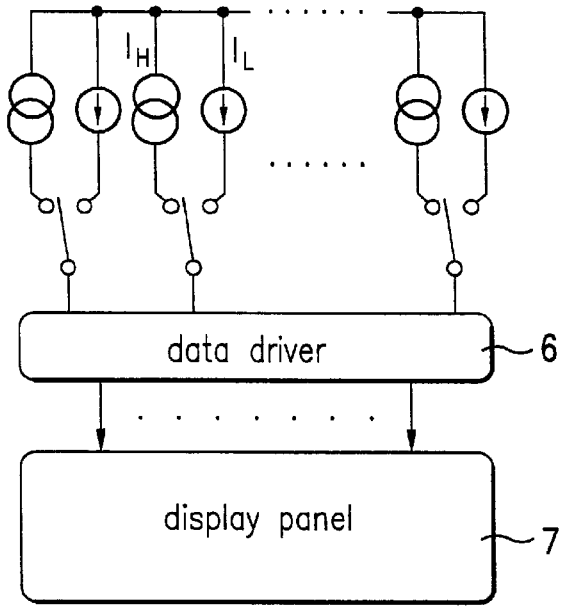
FIG. 4A Related Art
FIG. 4A illustrates a current driving type circuit.
Figure 4B:
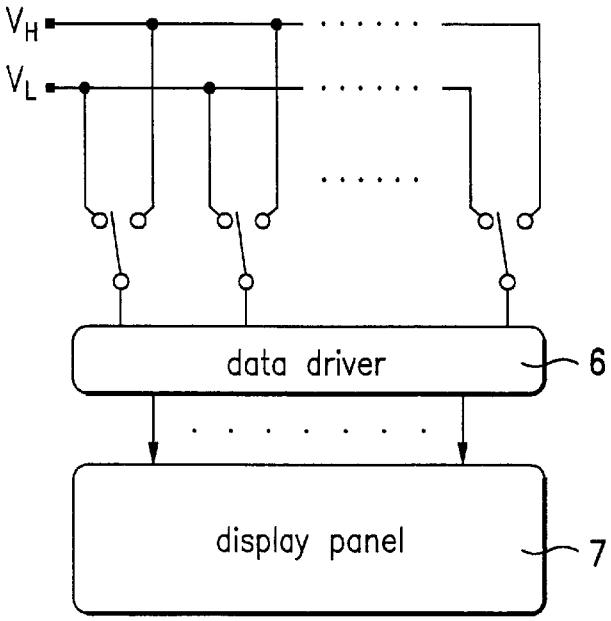
FIG. 4B Related Art
FIG. 4B illustrates a voltage driving type circuit.
Figure 5:
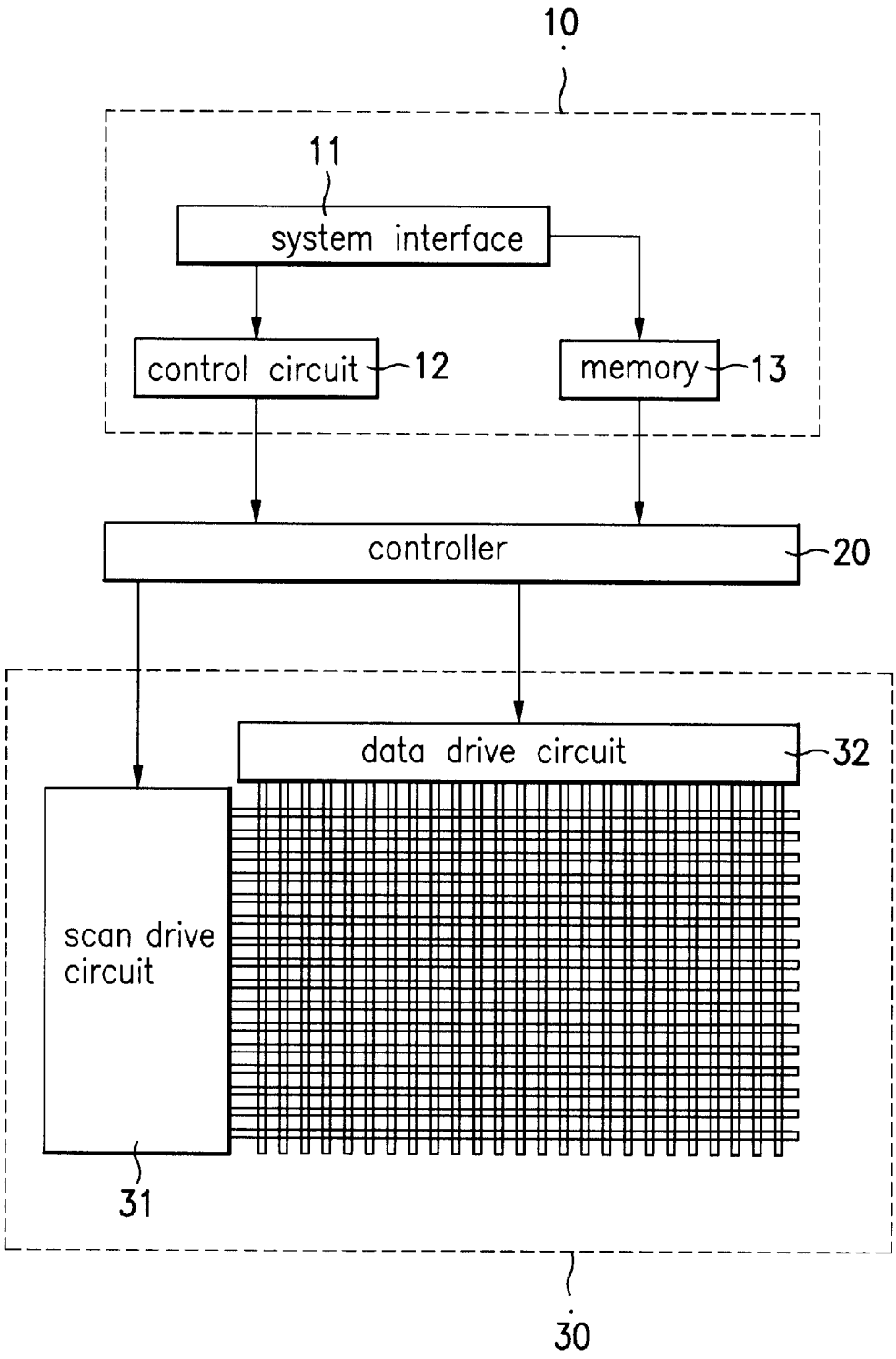
FIG. 5 illustrates a display device having a driving circuit in accordance with a preferred embodiment of the present invention.

FIG. 5 illustrates a display device, preferably a flat panel display, having a driving circuit in accordance with a preferred embodiment of the present invention. A reference signal circuit 10 receives an external video signal and provides a duty ratio of a scan signal and a video data. A controller 20 converts the duty ratio from the reference signal circuit 10 and generates an additional or remaining scan time period, and a display circuit 30 receives the duty ratio converted at the controller 20 and the video data to be displayed on a panel.

The reference signal circuit 10 includes a system interface 11 for converting an external video signal into a control signal and video data required for display. A control circuit 12 fixes identical duty ratios according to the control signal converted at the system interface 11, and a memory 13 stores the video data converted at the system interface 11. The display circuit 30 includes a data drive circuit 32 for providing data from the data signal controller 26 (FIG. 6) of the controller 20 to the data lines, and a scan drive circuit 31 for providing a drive signal from the scan signal controller 25 (FIG. 6) of the controller 20 to the scan lines. In the preferred embodiment, while maintaining a frame frequency identical to a signal of the duty ratio fixed at the reference signal circuit 12, the controller converts the duty ratio to be less than the duty ratio from the control circuit 12 such that there are extra or remaining scan drive time period, which can be added to a particular line when brighter luminance is desired.

Figure 6:
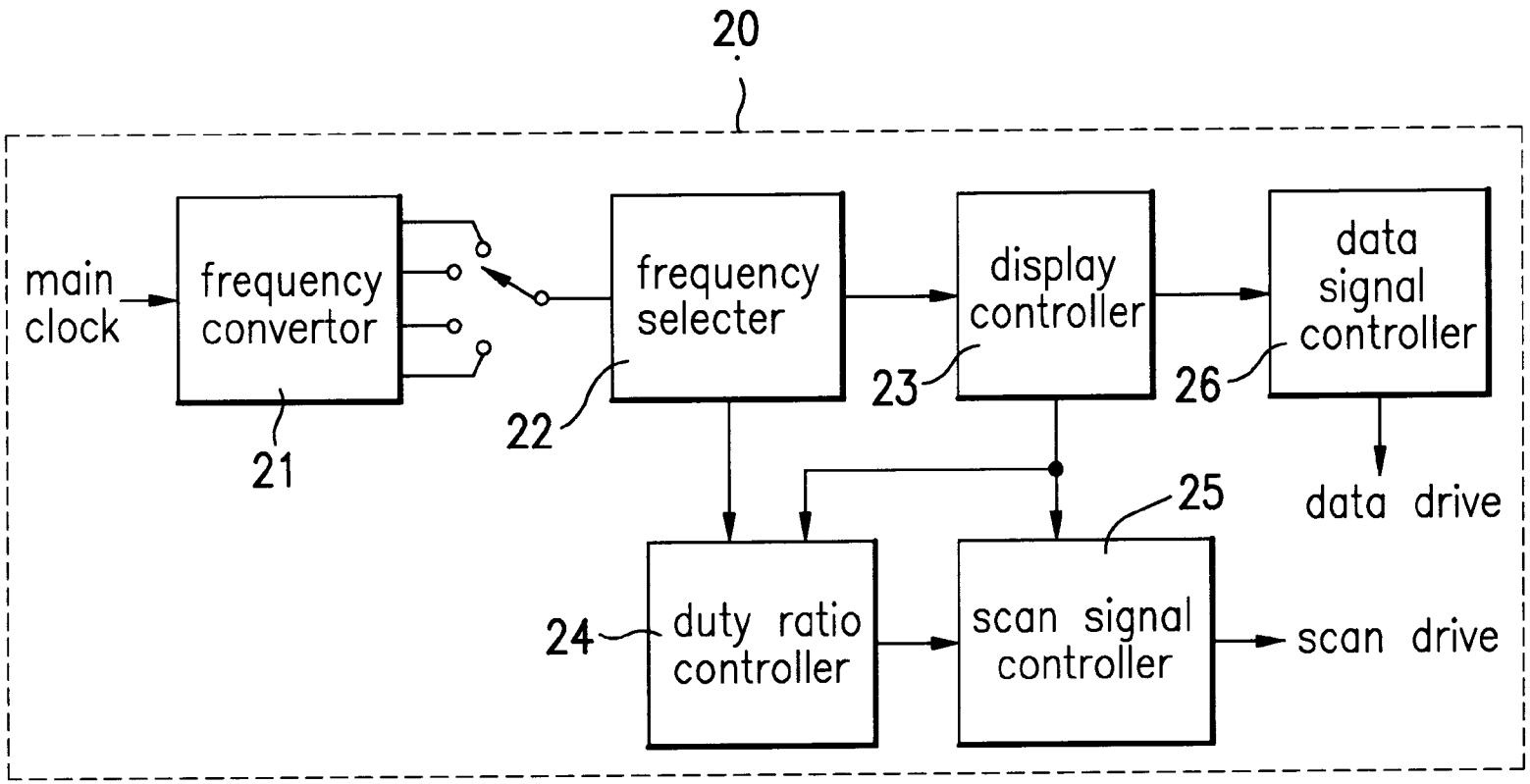
FIG. 6 illustrates a block diagram of a controller illustrated in FIG. 5 in accordance with a preferred embodiment of the present invention.

FIG. 6 illustrates a block diagram of a controller 20 in accordance with a preferred embodiment of the present invention. A frequency converter 21 generates a plurality of clock signals to convert a duty ratio of a main clock signal from the control circuit 12. A frequency selector 22 selects one of the plurality of clock signals as a reference clock. A duty ratio controller 24 sets the selected reference clock as a duty ratio, and a scan signal controller 25 generates a signal for driving the scan lines in the set duty ratio. A display controller 23 synchronizes the duty ratio controller 24 and the scan signal controller 25.

While maintaining a frame frequency the same, the controller 20 converts a first duty ratio from the control circuit to a second duty ratio, where the second duty ratio is less than the first duty ratio such that additional scan drive time period(s) remained after driving the scan lines is added to a particular line(s) when a brighter luminance is desired. Hence, the scan line(s) having additional scan drive time is played brighter than other scan lines. In this instance, in order to convert a duty ratio while maintaining a frame frequency the same, conversion of a frequency for a timing control is required. Accordingly, a control clock $f_{control}$ required is calculated based on the following. $f_{control}$=(a number of clocks required for displaying one scan line)*(a number of frames)*(duty ratio)$^{-1}$ For example, when the frame frequency is 70 Hz and the duty ratio is 1/40, and if 100 clock cycles are required for displaying one scan line data, the control clock $f_{40}$ can be expressed as follows.

$$f_{40}=100*40*70=280 \text{ kHz}$$

However, if the duty ratio is 1/48 under the same condition with the embodiment, the control clock $f_{48}$ can be expressed as follows.

$$f_{48}=100*48*70=336 \text{ kHz}$$

As shown in FIG. 6, the frequency converter 21 generates a plurality of clock signals based on $f_{control}$. Once a duty ratio is determined, the clock generated at the frequency converter 21 is taken as a control clock signal at the frequency selector 22, and used as a reference clock of display device. The control signal, received through the system interface 11, converts a number of pulses which can drive scan lines for one frame time period according to the set up of the duty ratio.

Figure 7:
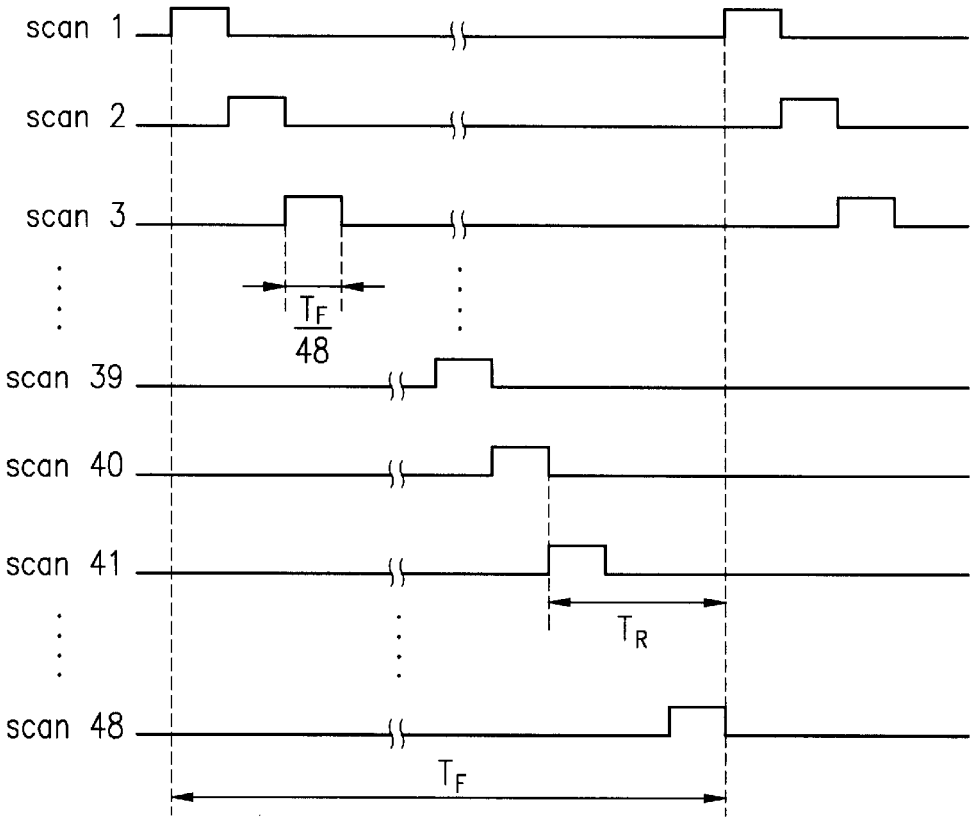
FIG. 7 illustrates a drive timing diagram of scan lines, each having a duty ratio set to 1/48 in accordance with a preferred embodiment of the present invention.
Figure 8:
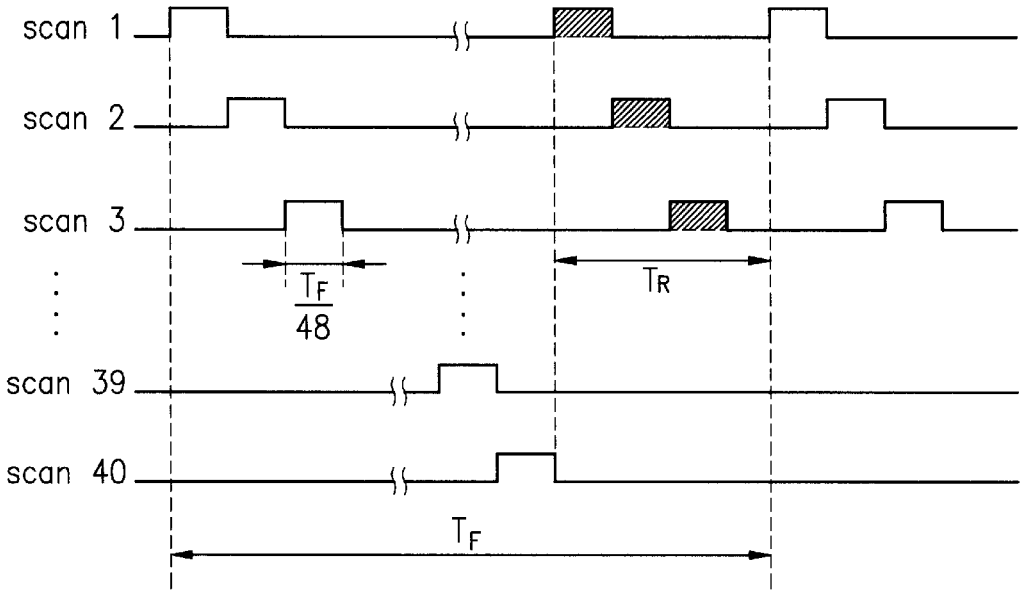
FIG. 8 illustrates a timing diagram when a remaining scan time period(s) after 40 scan lines is provided to an arbitrary scan line.

FIG. 7 illustrates a drive timing diagram of a duty ratio set to 1/48, and FIG. 8 illustrates a timing diagram when additional scan time period(s) remaining in FIG. 7 is provided to an arbitrary scan line(s) of 40 scan lines.

Referring to FIG. 7, when the duty ratio is 1/48 and one frame time period is $T_F$, a scan time period allocated to each scan line is $T_F/48$. The allocated scan time period should be applied to 48 scan lines, but when the allocated scan time period is applied to 40 scan lines, there are eight additional scan time period(s) (a remaining time period, $T_R$), i.e.,$8T_F/48$. As shown in FIG. 8, if the remaining time period $T_R$ is applied up to scan lines 1~8 each, a scan drive time period of the scan lines 1~8 is $2T_F/48$, providing twice the drive time period in comparison to other scan lines.

Generally, the additional scan time period(s) can be used as follows:

(1) All scan lines are displayed, and one or entire portion of the remaining time period $T_R$ can be applied to a scan line desired to display brighter than other scan lines.

(2) One or entire portion of the remaining time period $T_R$ can be applied to the scan line desired to display brighter than other scan lines in succession, and rest of the scan lines are displayed in succession during rest of the drive time period.

(3) A luminance of a particular line can be varied in steps, wherein the remained time period $T_R$ is adjusted through masking, for varying a driving time period of the scan line intended to display brighter than other scan lines for adjusting a luminance.

Figure 9:
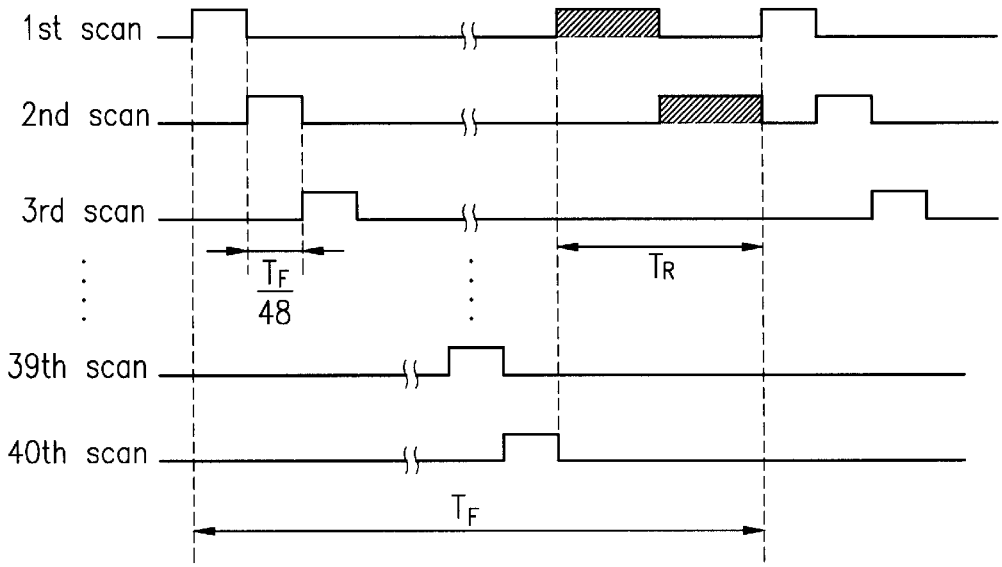
FIG. 9 illustrates one embodiment of scan line driving method in accordance to a preferred embodiment of the present invention.

FIG. 9 illustrates an application of method (1) above, wherein four pulses, one half of the eight pulses of the remaining time period $T_R$, are applied to a first line, and four pulses of the eight pulses of the remaining time period $T_R$, are applied to a second line. In this instance, since a driving time period $5T_F/48$ of the first and second scan lines is five times greater than $T_F/48$ of the other scan lines, the first and second lines are brighter.

Figure 10:
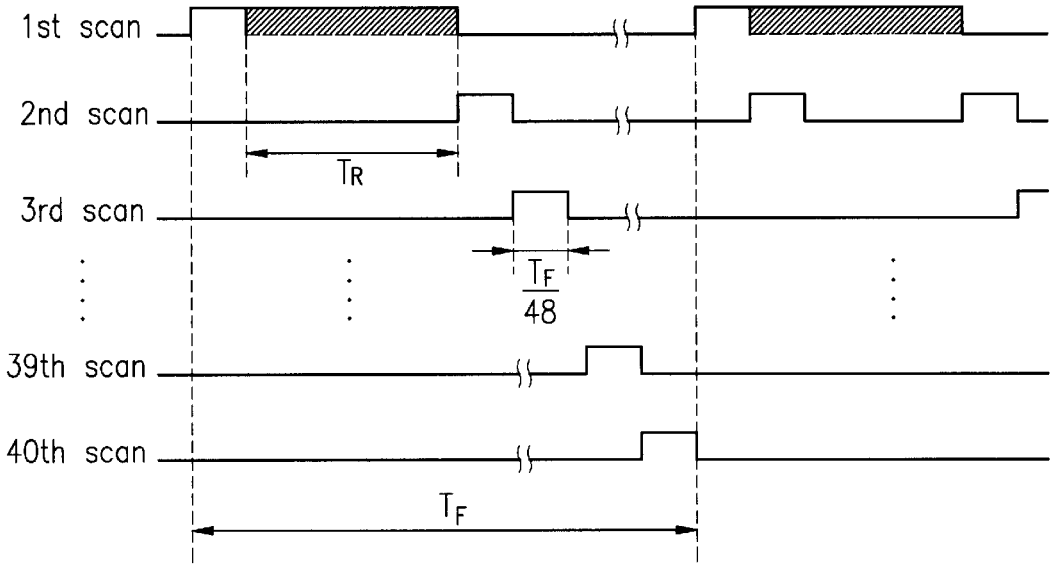
FIG. 10 illustrates another embodiment of scan line driving method in accordance to a preferred embodiment of the present invention.

FIG. 10 illustrates an application of method (2) above, wherein the eight pulses of the remaining time period $T_R$ are applied to the first scan line, and the other scan lines are driven in succession, thereby causing the first line to be brighter.

Figure 11:
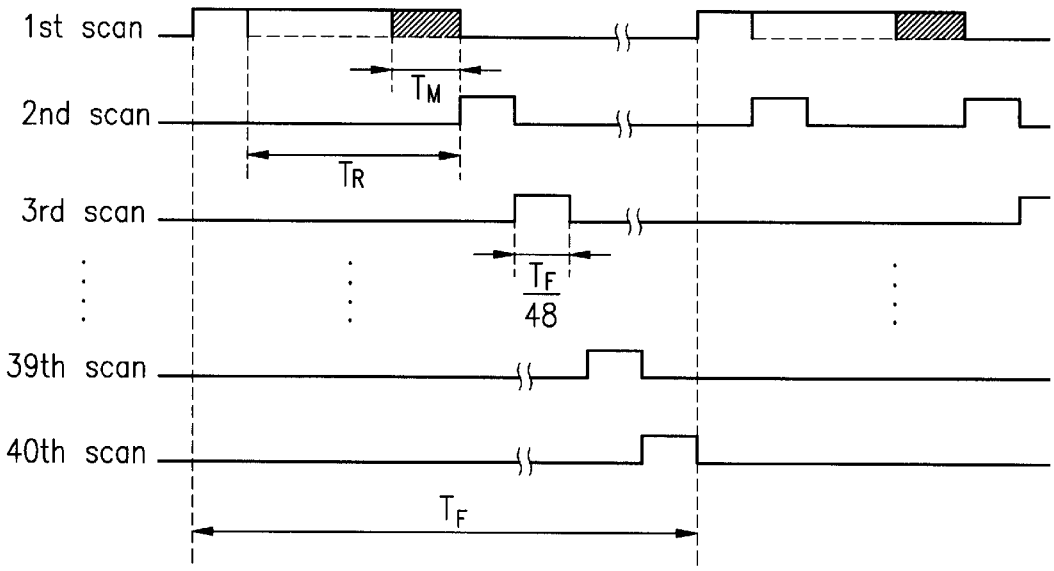
FIG. 11 illustrates a further embodiment of scan line driving method in accordance to a preferred embodiment of the present invention.

FIG. 11 illustrates an application of method (3) above, wherein the remaining time period TR is masked, to vary luminance of a particular line in steps, to control a luminance of the scan line to as desired. A time period $T_M$ generated through masking is generated by successive combination of the duty ratio.

Figure 12:
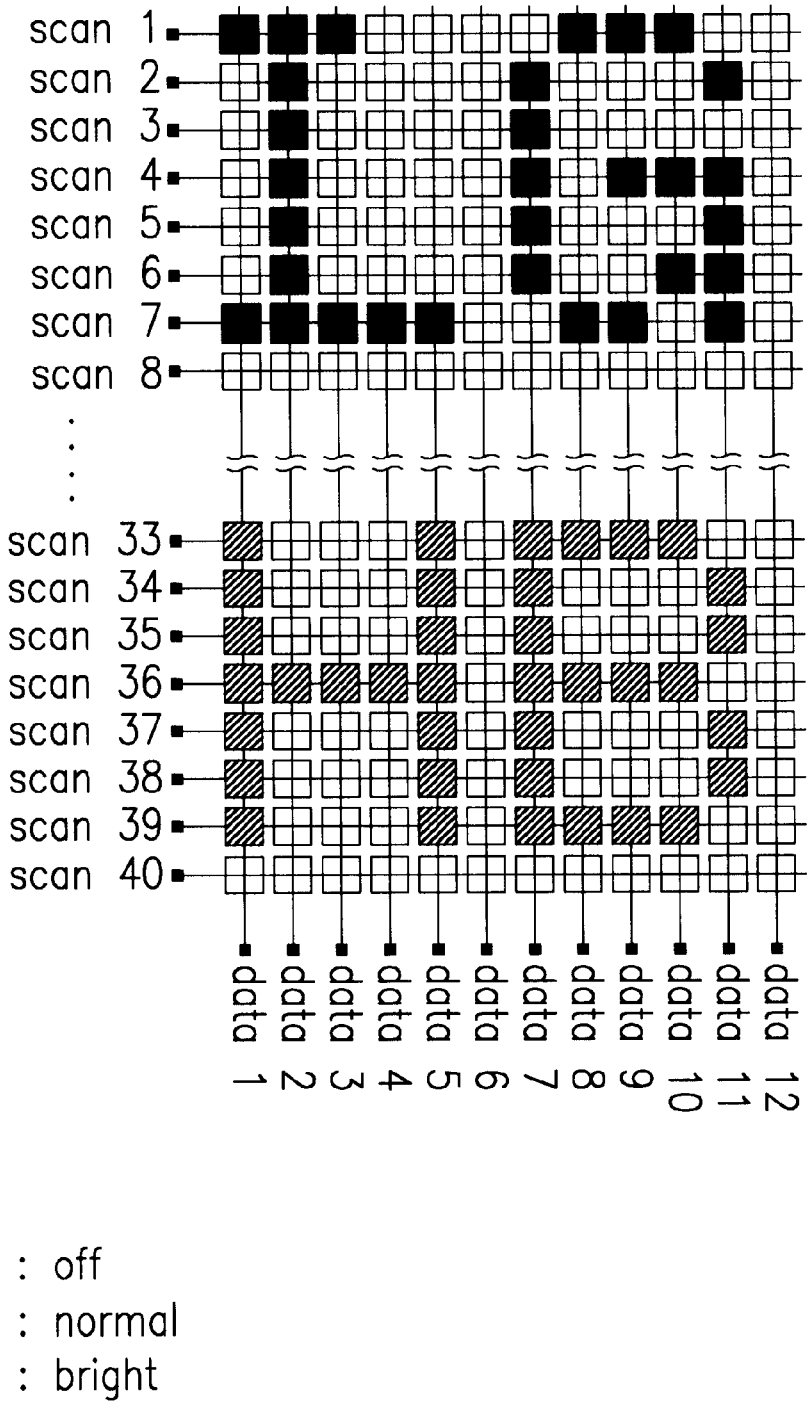
FIG. 12 illustrates an image/text displayed by the display device and method in accordance with a preferred embodiment of the present invention.

FIG. 12 illustrates a flat display displaying characters by applying the additional time period to scan lines 1~8 in accordance with a preferred embodiment of the present invention. The present invention can display characters "LG" intended to emphasize brighter than characters "HB". However, the characters displayed in FIG. 12 is a result obtained by controlling by each scan line unit, which is not suitable when it is desired to display a portion of data on data lines brighter than other data. In other words, in data "LG" displayed brighter in FIG. 12 as an embodiment, if it is desired to display only "L" brighter than the "G", it is not possible to implement because the data is displayed in scan line unit.

In order to emphasize a data on a portion of data line, a data line controlling method is preferably employed, in addition to the scan line controlling method. To implement the data line controlling method, a masking method is used. In the masking method, while driving particular scan lines, and leaving data on data line intended to display brighter as they are, data on rest of the data lines are masked, resulting in erasure of the data, and preventing the masked data from being displayed brighter than other data. Hence, a data signal controller 26 of FIG. 6 is provided for converting data by applying the masking method when the scan signal controller 25 of FIG. 6 provides the remained scan time period to a particular scan line.

When the remaining scan time period is applied to particular scan lines by the data scan signal controller 26 to drive the scan lines, the data signal controller 25 applies the data to be displayed to the data lines, and the particular portion is emphasized by masking a portion of data applied to the data lines. Since the data signal controller 26 operates identical to operation of a general flat display up to scan lines 1~40, and masks the data putting a portion of data desired to display brighter than other portion among scan lines 41~48 aside, the data signal controller 26 can display data brighter than other data partially.

Figure 13:
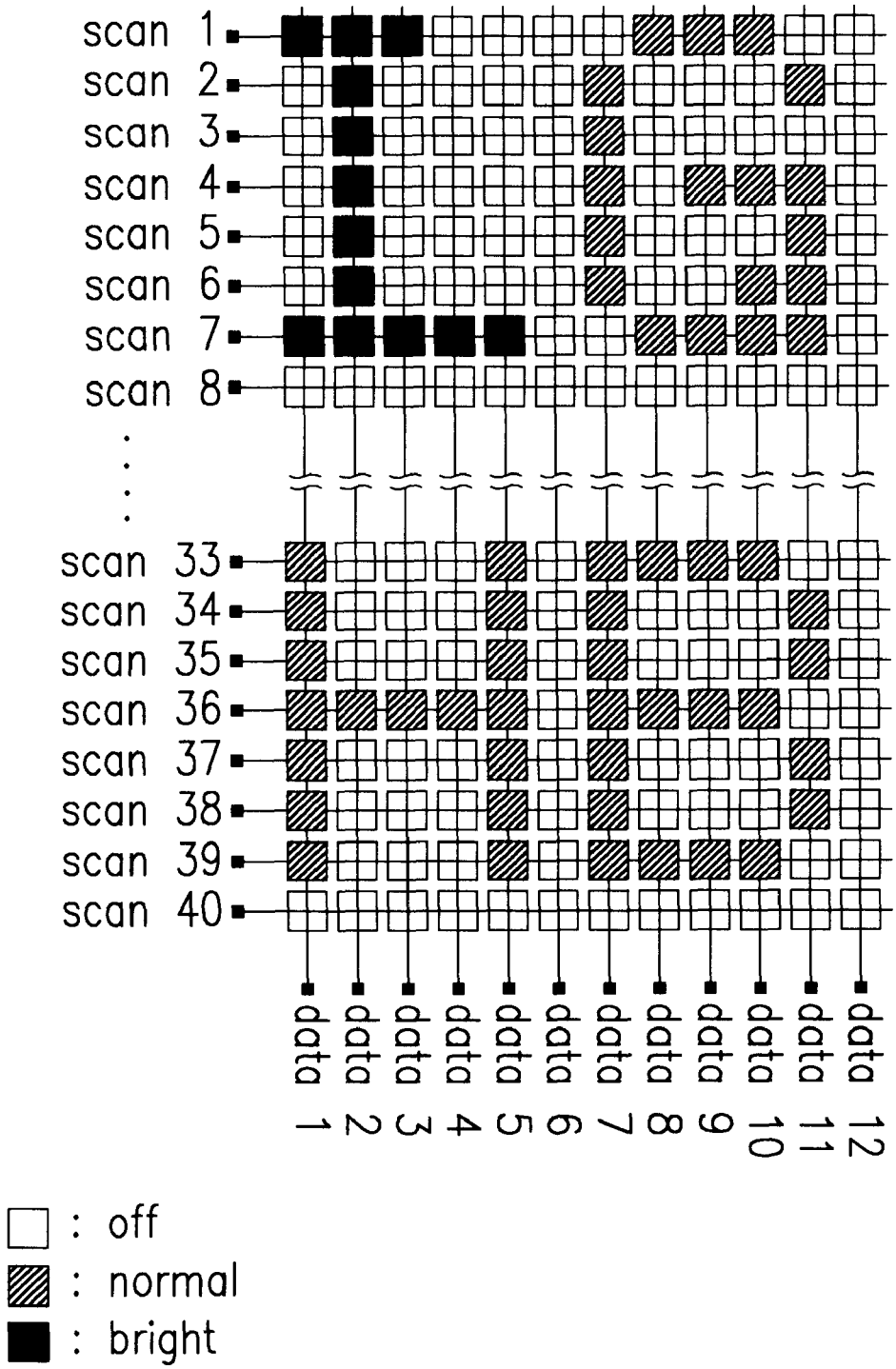
FIG. 13 illustrates an image/text displayed by the display device using data masking in accordance with a preferred embodiment of the present invention.
Figure 14:
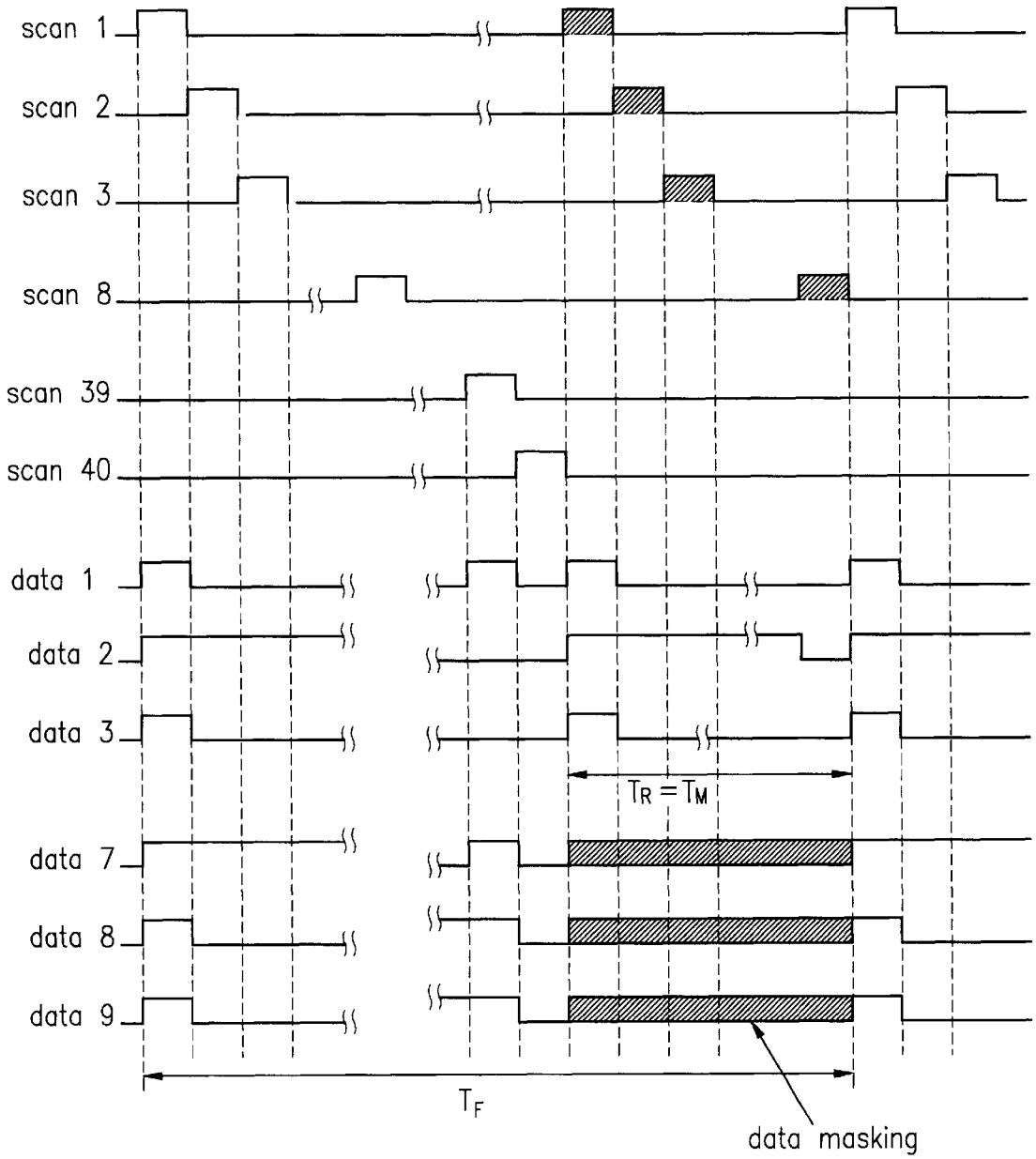
FIG. 14 illustrates a timing diagram of waveforms for displaying the image/characters of FIG. 13.

FIG. 13 illustrates a flat display displaying characters by using data masking of the present invention, and FIG. 14 illustrates a timing diagram showing waveforms for displaying the image/characters in FIG. 13. Referring to FIG. 14, by providing the same driving time periods to all pixels for the while in which the remained scan time period $T_R$ is excluded from one frame time period $T_F$. The remaining scan time period a $T_R$ is applied to the scan lines 1~8, and only data lines 1~6 are driven among the plurality of data lines, characters on data lines up to 1~6 have two times of driving time period compared to other characters in one frame period. Accordingly, as shown in FIG. 14, only the character "L" on data lines up to 1~6 among characters on 12 data lines is displayed brighter than other characters.

A driving time period of the driven scan lines is varied in steps, and a plurality of scan lines may be also driven. In the case of data lines, the masking time period $T_M$ can be varied in steps, and, also, all desired data on a plurality of data lines can be masked. Thus, by controlling the remaining time period $T_R$ at the scan signal controller 25, scan lines of which luminance control is desired can be controlled, and by selectively controlling only data on data lines luminances thereon are desired to control at the data signal controller 26, to mask data in unnecessary portions, luminance of data at any position on a data display panel can be controlled. In this instance, though a time period for driving each scan line becomes shorter as the duty ratio becomes the greater, because the reduction of the scan line driving time period caused by the duty ratio control is identical all over, and the reduced time period is very small compared to a scan line driving time period, no overall data display is affected.

The present invention has various advantages. For example, since the device and method for controlling a luminance of a flat display of the present invention can display a data on a particular line with a luminance of the data varied in steps without additional power consumption in displaying the data on a display, an effective data delivery to a user is available. Further, the stepwise variation of luminance of a particular portion of data among data displayed on a particular line or panel in displaying data on a display permits to deliver data more precisely. By applying to different flat display, a particular portion of data can be displayed more clearly without additional power consumption. Moreover, the implementation with digital circuit without providing an additional circuit inside of a chip for controlling a luminance of data at a particular position is advantageous in view of utilization of a chip area.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A driving circuit for a display device, comprising:

a reference signal generator that receives video signal, said reference signal generator generating a first duty ratio and a video data;

a controller receiving the first duty ratio and video data, said controller converting the first duty ratio to a second duty ratio when a luminance of a pixel of the display device is to be changed, said second duty ratio being less than the first duty ratio;

a driver circuit that used the second duty ratio and video data for displaying at least one of image and text, wherein the controller includes a scan controller circuit for converting the first duty ratio to the second duty ratio thereby changing a first scan time period to a second time period within which a scan line is driven for one frame period such that there is an additional scan time period for driving a plurality of scan lines, and the scan controller applying the additional scan time period to a scan line desired to display brighter than other scan lines.

2. The circuit of claim 1, wherein the controller includes:

a frequency converter that generates a plurality of second clock signals based on a first clock signal;

a frequency selector for selecting one of the plurality of second clock signals as a reference clock signal;

a duty ratio controller for setting up the second duty ratio based on the reference clock signal;

a first signal controller for generating a first signal for driving a first signal line based on the second duty ratio; and a display controller for synchronizing the duty ratio controller and the first signal controller.

3. The circuit of claim 2, wherein said first signal controller is a scan signal controller and the first signal line is a scan line.

4. The device of claim 3, wherein the controller further includes a data signal controller for converting a data by using masking in applying an additional scan time period remaining based on the second duty ratio to a particular scan line.

5. The circuit of claim 1, wherein the reference signal generator includes:

a system interface for receiving a video signal and converting the video signal to a control signal and video data for display;

a control circuit for fixing the first duty ratio in response to the control signal; and a memory for storage of the video data.

6. The circuit of claim 1, wherein the controller further includes a data controller for driving a portion or entire data corresponding to the scan lines applied and masking the rest of the data.

7. The circuit of claim 1, wherein the additional scan time period is applied to a single scan line.

8. The circuit of claim 1, wherein the additional scan time period is divided into a plurality of additional scan time periods, each being applied to a corresponding scan line for brighter luminance or the plurality of additional scan time periods being to a prescribed number of the plurality of scan lines, respectively.

9. The circuit of claim 1, wherein the plurality of additional scan time periods is adjusted through masking.

10. The circuit of claim 1, wherein the driver circuit includes:

a data driver for applying video data from the controller to a plurality of data lines; and a scan driver for applying a driving signal based on the second duty ratio from the controller to a plurality of scan lines, for displaying at least one of image and text.

11. The driving circuit of claim 1, wherein the additional scan time period includes a number N of additional scan signals, where $1 \leqq N <$ the number of scan lines.

12. A controller for a display device comprising:

a scan controller circuit for converting a first duty ratio based on a first scan time period for each of a plurality of scan lines to a second duty ratio based on a second scan time period within which each scan line is driven for one frame period; and a data controller circuit for driving a portion or entire data corresponding to the scan lines, wherein the second duty ratio is less than the first duty ratio such that there are additional second scan time period remaining for driving the plurality of scan lines within one frame period, wherein the additional second scan time period is used in at least one of the following:

(a) the additional second scan time period is applied to a single scan line, (b) the additional second scan time period is divided into a plurality of additional scan time periods, each being applied to a corresponding scan line for brighter luminance or the plurality of additional scan time periods being applied to a prescribed number of the plurality of scan lines, respectively, and (c) the additional second scan time period is adjusted through masking.

13. The controller of claim 12, wherein the data controller circuit converts a data by using masking in applying the additional second scan time period to a corresponding scan line.

14. The controller of claim 12, wherein the additional scan time period includes a number N of additional scan signals, where 1≦N<the number of scan lines.

15. A display device, comprising:

a input device receiving a video signal and generating a first duty ratio and video data;

a controller that changes the first duty ratio to a second duty ratio; and a display panel having a plurality of scan lines and a plurality of data lines intersecting at a plurality of pixels, said plurality of scan lines being driven based on the second duty ratio and video data being provided to the plurality of data lines to display at least one of an image and text, wherein the controller includes a scan controller circuit for converting the first duty, ratio to the second duty ratio thereby changing a first scan time period to a second time period within which a scan line is driven for one frame period such that there is an additional scan time period for driving a plurality of scan lines, and the scan controller applying the additional scan time period to a scan line desired to display brighter than other scan lines.

16. The display devise of claim 15, wherein the additional scan time period includes a number N of additional scan signals, where 1≦N<the number of scan lines.

17. A method for controlling a luminance of a flat display, comprising:

(1) while a frame frequency is maintained, adjusting a duty ratio of a scan time period for generating additional scan time period; and (2) adding the additional scan time period to all scan lines desired to be displayed brighter than other scan lines, wherein the additional second scan time period is used in at least one of the following:

(a) the additional second scan time period is applied to a single scan line, (b) the additional second scan time period is divided into a plurality of additional scan time periods, each being applied to a corresponding scan line for brighter luminance or the plurality of additional scan time periods being applied to a prescribed number of the plurality of scan lines, respectively, and (c) the additional second scan time period is adjusted through masking.

18. The method of claim 17, wherein the step (2) further includes the step of displaying only driving data on a plurality of data lines desired to display brighter while the driving data on rest of the data line are masked, for selectively driving the data lines.

19. The method of claim 18, wherein the step of driving the data lines further includes the step of adjusting the driving time period through partial masking of the data on a particular data line desired to display brighter for adjusting a luminance of the data.

20. The method of claim 17, wherein step (2) includes the steps of:

driving the scan lines starting from beginning in succession by using the adjusted duty ratio; and adding a portion or entire additional scan time period to the scan lines desired to display brighter than other scan lines, and driving the scan lines.

21. The method of claim 17, wherein step (2) includes the steps of:

selectively applying a portion or entire additional scan time period to the scan lines desired to display brighter than other scan lines; and applying a fixed time period to all the scan lines in succession using the adjusted duty ratio.

22. The method of claim 17, wherein step (2) includes the steps of:

partially masking a data on a particular scan line desired to display brighter than other scan lines, to adjust a driving time period therefor, for adjusting a luminance of the data.

23. The method of claim 17, wherein the additional scan time period includes a number N of additional scan signals, where 1≦N<the number of scan lines.

24. The method of claim 17, where the duty ratio is adjusted to a lesser duty ratio.

25. A driving circuit of a display panel comprising:

a scan electrode driving part for sequentially applying scan signals to each scan electrode, so as to drive a display panel of a passive matrix type including a plurality of pixels defined by crossing a plurality of scan electrode lines to a plurality data electrode lines;

a data electrode driving part for applying a data signal to a data electrode; and a control part for controlling each driving part, wherein the control part generate the scan signals greater than a number of the scan electrode lines so as to provide additional scan signals, and the scan electrode driving part is controlled apply the additional scan signals to scan electrode lines desired to be brighter than the others.

26. The driving circuit of claim 25, wherein the number of the additional scan signals N is 1≦N<the number of scan lines.

27. The driving circuit of claim 25, wherein the additional scan signal are used when a brighter luminescence is desired for a prescribed number of pixels.

28. The driving circuit of claim 25, wherein the scan electrode driving part switches the applied additional scan signal.

29. The driving circuit of claim 25, herein the data electrode driving part is controlled to mask the data signal.

30. The driving circuit of a display panel comprising:

a scan electrode driving part for sequentially applying scan signals to each scan electrode, so as to drive a display panel of a passive matrix type including a plurality of pixels defined by crossing a plurality of scan electrode lines to a plurality data electrode lines;

a data electrode driving part for applying a data signal to a data electrode; and a control part for controlling each driving part, wherein the control part generate the scan signals greater than a number of the scan electrode lines so as to provide additional scan signals, and the scan electrode driving part is controlled to apply the additional scan signals to scan electrode lines desired to be brighter than the others, and the data driving part is controlled to mask data signals on rest of the data lines except for data lines desired to display brighter than the others.

31. The driving circuit of claim 30, wherein the number of the additional scan signals N is 1≦N<the number of scan lines.

32. The driving circuit of claim 30, wherein the additional scan signal are used when a brighter luminescence is desired for a prescribed number of pixels.

33. The driving circuit of claim 30, wherein the scan electrode driving part switches the applied additional scan signal.

* * * * *